US006839910B2

(12) United States Patent
Morrow et al.

(10) Patent No.: US 6,839,910 B2
(45) Date of Patent: Jan. 11, 2005

(54) PROTECTIVE ATHLETIC EQUIPMENT

(76) Inventors: David Morrow, 28454 Wellington, Farmington Hills, MI (US) 48334; Jesse Hubbard, 7 E 14th St., Apt. 510, New York, NY (US) 10003

( * ) Notice: Subject to any disclaimer, the term of this patent is extended or adjusted under 35 U.S.C. 154(b) by 82 days.

(21) Appl. No.: 10/190,216

(22) Filed: Jul. 5, 2002

(65) Prior Publication Data

US 2004/0003448 A1 Jan. 8, 2004

(51) Int. Cl.[7] ..... A41D 13/00
(52) U.S. Cl. ..... 2/92
(58) Field of Search ..... 2/92, 455, 267, 2/44, 45, 462, 463, 464, 467, 459, 461, 102, 2.5, 913, DIG. 3

(56) References Cited

U.S. PATENT DOCUMENTS 4,441,211 A * 4/1984 Donzis ..... 2/459
4,453,271 A * 6/1984 Donzis ..... 2/456
4,513,449 A * 4/1985 Donzis ..... 2/462
4,985,931 A * 1/1991 Wingo, Jr. ..... 2/462
5,173,964 A 12/1992 Ball et al.
5,530,966 A 7/1996 West

OTHER PUBLICATIONS

STX Lacrosse Catalog 2000; Prototype Athletic Equipment.

* cited by examiner

*Primary Examiner*—Tejash Patel
(74) *Attorney, Agent, or Firm*—Artz & Artz, PC

(57) ABSTRACT

A protective garment (10) is provided for cushioning blows imparted upon the wearer's body. Preferably, the protective garment (10) is an upper body protection garment (10) that is intended to cushion blows imparted upon the upper body of a user. The upper body protective garment (10) includes a chest protector portion (12), a back protector portion, and a pair of shoulder protector portions (14). These protector portions (12,14) preferably form a single integral unit. An absorbing cap (18) is preferably located on each of the shoulder protector portions (14) and the chest protector portion (12). The absorbing cap (18) includes an inner shell (22) that is secured to the protector portion (12,14) and a resilient outer shell (20) that is secured to the protector portion (12,14) about its periphery (28) but has a portion that is spaced apart from and above the stiff inner member to form a cavity (24) therebetween. The absorbing cap (18) disperses the force from a blow delivered to an individual's upper body by allowing that resilient outer shell (20) to move inwardly toward the inner shell (22).

32 Claims, 4 Drawing Sheets

PROTECTIVE ATHLETIC EQUIPMENT

TECHNICAL FIELD

The present invention relates generally to protective garments for an individual's body, and more particularly to protective garments with resilient outer shells integrated therein for cushioning against blows imparted upon the upper body during athletic competition.

BACKGROUND OF THE INVENTION

Upper body protective garments are commonly worn by participants of contact sports for the purpose of preventing injuries to their shoulders, back, and chest. These kinds of injuries are ordinarily associated with sports such as lacrosse, hockey, and football. In these contact sports, various situations may cause upper body injuries. Examples of these situations include tackling or otherwise bumping into other players, falling to the ground, being struck by another player's equipment, or being struck by game ball itself. Of course, upper body protective garments may reduce or prevent injuries resulting from various other circumstances, including those not associated with contact sports.

Existing upper body protective garments utilize a relatively significant amount of foam padding for absorbing the energy of blows delivered to the user's upper body. Moreover, a rigid cover, typically made of plastic, usually overlays the foam padding so as to distribute the force of the blow across a larger area of the foam padding. As is known in the art, distributing the force in this manner permits the foam padding to absorb a substantial portion of the energy associated with the blow.

A drawback of using foam padding is that the repeated compression and expansion of the foam padding may over time cause the foam padding to fatigue and lose its ability to absorb energy. Another drawback is that the combined use of the foam padding and the rigid cover adds relatively significant weight to the protective garment. Since lightweight athletic garments are known for allowing players to expend more energy participating in the sport instead of carrying the weight of the gear, the added weight is an undesirable result.

Therefore, a need exists for upper body protective gear that cushions against powerful blows and is relatively lightweight and long-lasting.

Protective equipment also exists to protect other parts of the body from injury during contact athletic events. Such protective equipment includes gloves, shin guards, and hip pads. This protective equipment like the upper body protective gear described above, is typically comprised of foam padding or foam padding with a plastic cover and thus suffers from the same deficiencies discussed above.

Therefore, a need also exists for protective equipment for any part of the body that cushions against powerful blows and is relatively lightweight and long-lasting.

SUMMARY OF THE INVENTION

It is therefore an object of the present invention to provide protective equipment with improved protection for the body of a user.

It is another object of the present invention to provide protective equipment that is durable and can withstand a substantial number of blows over a significant period of time.

It is yet another object of the present invention to provide protective equipment that is lightweight and allows a user to expend less energy carrying the garment.

In accordance with the above and other objects of the present invention, a protective garment is provided for cushioning blows imparted upon the body of a user. The protective garment includes a first portion that is intended to overlay a portion of the user's body and provide protection thereto. The first portion includes a resilient outer plastic shell and an inner shell separated from the outer shell. The outer shell and the inner shell are separated by non-pressurized gas and form a cavity therebetween. The combination of these elements allows for the absorption of the energy of a blow delivered to an individuals body.

One advantage of the present invention is that a user is protected from harmful forces that may injure his shoulders, chest, and back, as well as other parts of the body.

Another advantage of the present invention is that the protection garment has a minimized weight for permitting a user to expend more energy participating in an ongoing activity, rather than in merely carrying the garment.

Yet another advantage of the present invention is that the protection garment is durable and can absorb numerous blows over a substantial period of time.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE PREFERRED EMBODIMENT

Figure 1:
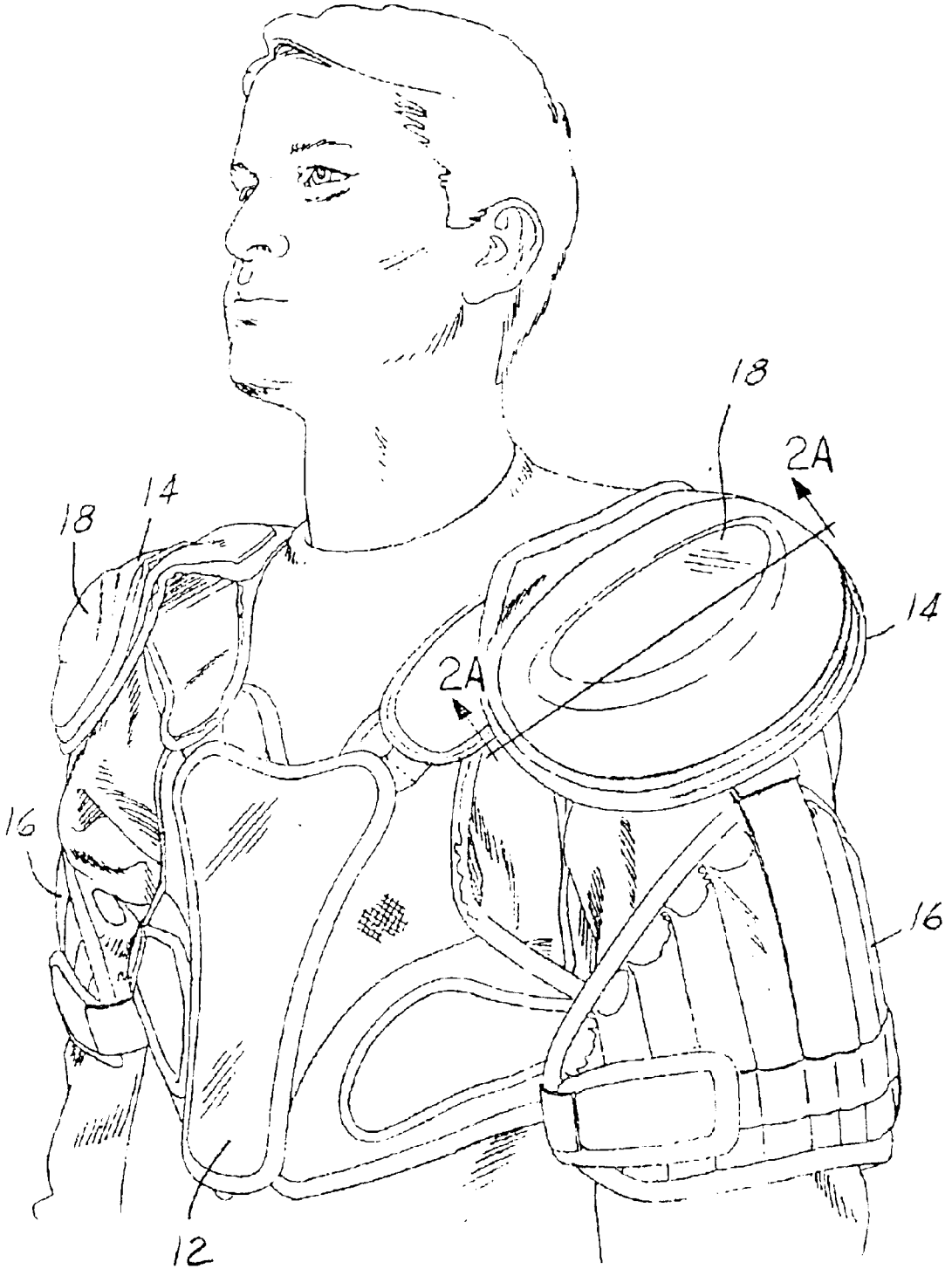
FIG. 1 is a perspective view of an upper body protective garment worn by a user, in accordance with a preferred embodiment of the present invention.

In the following figures, the same reference numerals are used to identify the same components in the various views.

Referring to FIG. 1, there is generally shown an upper body protective garment 10 ("garment") worn by a user for the purpose of cushioning against blows delivered to the user's upper body. In general, the garment 10 includes a pair of shoulder protector portions 14 with a chest protector portion 12 and a back protector portion (not shown) extending therefrom. Also, the sides of the chest protector portion 12 and the back protector portion may be joined by adjustable straps or various other attachment devices. The pair of shoulder protector portions 14, the chest protector portion 12, and the back protector portion are preferably configured as a single unit such that the user can put it on as a single unit.

It will be appreciated that while the protective garment is preferably for protecting the upper body of a user, it will be understood that the protective garment may be utilized to protect a variety of different body parts. The protective garment may, for example, be used to protect a user's elbow, shin, hand, wrist, forearm and hip as well as other parts of the body.

The garment 10 also preferably includes an arm protector 16 extending from each shoulder protector portion 14. These arm protectors 16 are well known in the art and may be constructed from a variety of different compositions, including foam padding.

Figure 2A:
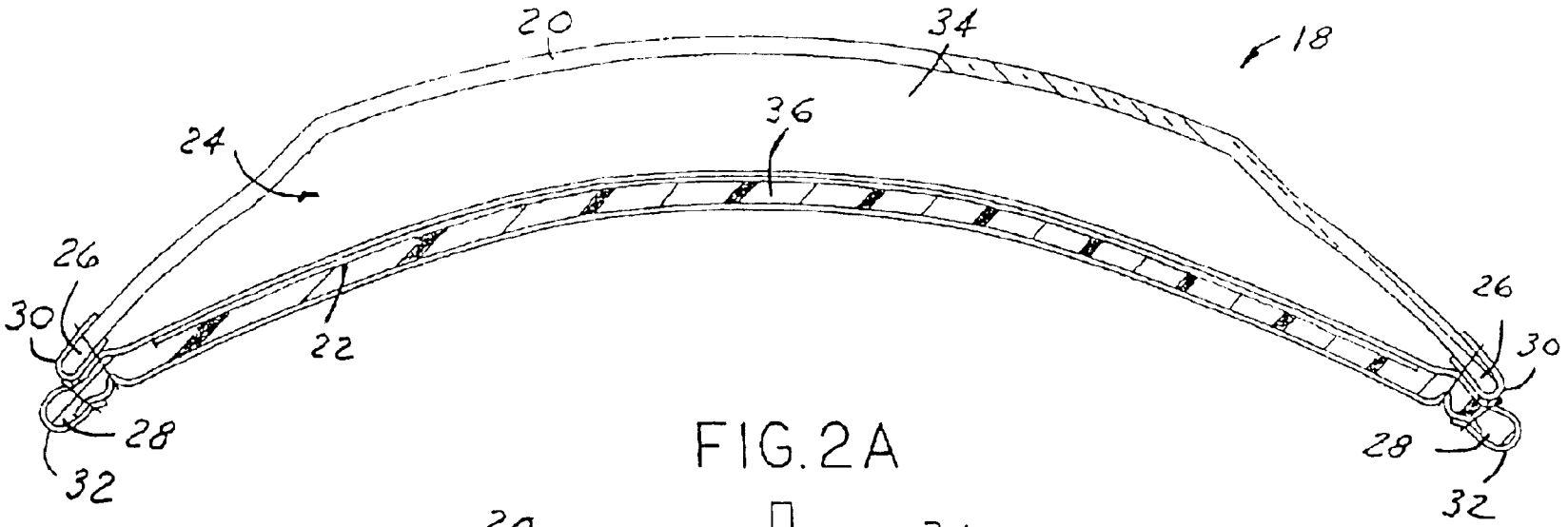
FIG. 2A is a cross-sectional view of a resilient force absorbing cap as shown in FIG. 1, taken along line 2A—2A.
Figure 2B:
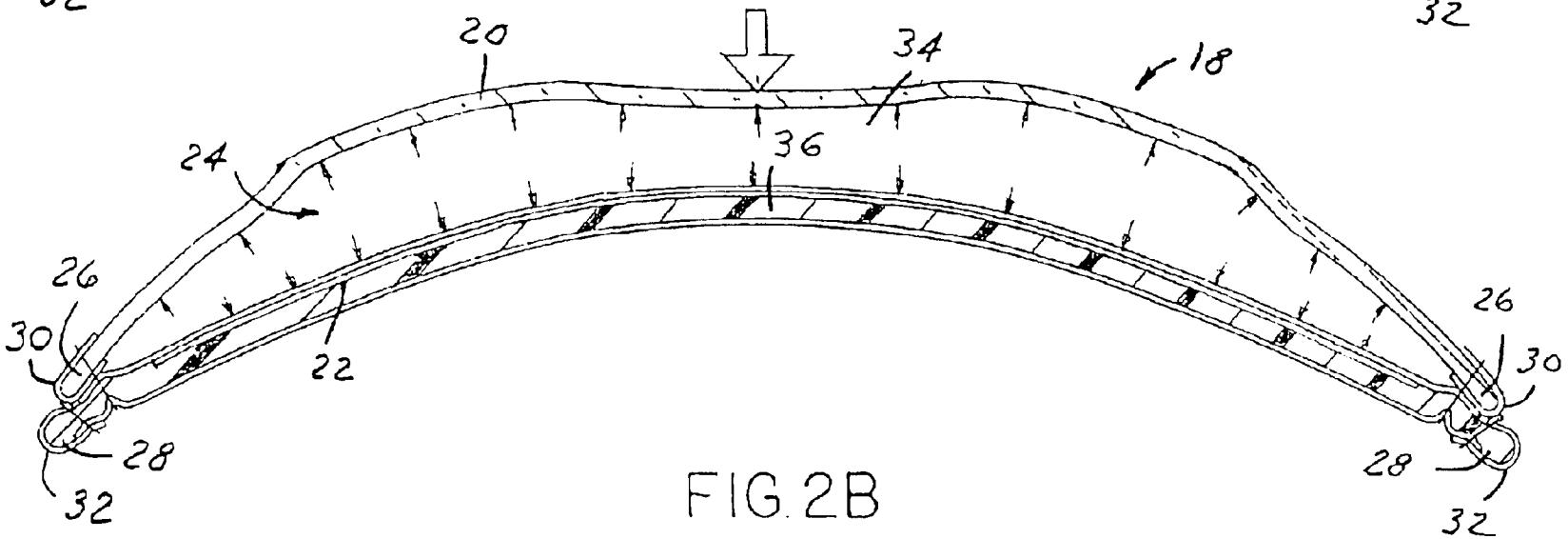
FIG. 2B is a cross-sectional view of a resilient force absorbing cap cushioning a blow, in accordance with a preferred embodiment of the present invention.

Referring primarily to FIGS. 2A and 2B, the chest protector portion 12 and the shoulder protector portions 14 each preferably include a resilient force absorbing cap 18 for cushioning against blows delivered to the user's upper body. Each cap 18 preferably includes a resilient outer shell 20 that is substantially spread across an inner shell 22 in a manner that leaves a cavity 24 between the resilient outer shell 20 and the inner shell 22. Specifically, a boundary portion 26 of the resilient outer shell 20 is preferably sewn or otherwise coupled to or adjacent to a peripheral portion 28 of the inner shell 22 such that substantially all of the outer shell 20 overlaps the inner shell 22. Alternatively, the absorbing cap 18 can be configured with the boundary portion 26 and the peripheral portion 28 both attached to the garment 10 such that a smaller portion of the outer shell 20 lies over the inner shell 22. The combination of the outer shell 20, the inner shell 22 and the cavity 24 form an absorbing cap 18. The absorbing cap 18 can be located anywhere on the garment as well as on any other piece of protective equipment.

The boundary portion 26 is preferably covered with a boundary guard 30 for preventing damage to the boundary portion 26 of the rigid outer shell 20 as well as to maintain it in place. The boundary guard 30 may be comprised of a cloth material, plastic material, or any other suitable material that prevents damage to the boundary portion 30. In this respect, the boundary guard 30 prevents initial tearing of the boundary portion 26, as well as subsequent tearing of the remainder of the resilient outer shell 20. Likewise, the peripheral portion 28 of the inner shell 22 is preferably covered by a periphery guard 32 that is similar to the boundary guard 30 in both structure and purpose.

The resilient outer shell 20 is preferably comprised of a flexible thermal-plastic material that deforms when subjected to a force and then returns to its original shape when the force is removed. Of course, the resilient outer shell 20 may be made of various other suitable materials that accomplish the same function. For example, it is envisioned that a flexible rubber material could also be utilized. The resilient outer shell 20 is intended to receive a blow and deform inwardly. As is known in the art, deformation of materials requires the absorption of energy. In this regard, the resilient outer shell 20 absorbs a substantial portion of the energy associated with the blow.

As shown in FIGS. 2A and 2B, the resilient outer shell 20 is preferably curved outward from the inner shell 22 in a manner that allows the resilient outer shell 20 to resist a substantial amount of force. In other words, the outer shell 20 preferably has a somewhat arcuate or dome shape.

Furthermore, the resilient outer shell 20 has an elevated shell portion 40 intended to provide enhanced protection to a portion of the user's body that is highly susceptible to injury. The elevated shell portion 40 is configured to overlie a more susceptible part of the body, such as a shoulder blade. The elevated shell portion 40 preferably is disposed slightly farther from the inner shell 22 than the remainder of the resilient outer shell 20. As a result, the elevated shell portion 40 would travel a greater distance before contacting the inner shell 22 and thus disperse more energy. In this regard, the elevated shell portion 40 preferably only contacts the inner shell 22 if the resilient outer shell 20 is substantially deformed. As is known in the art, substantial deformation of a material absorbs a significant amount of energy. Therefore, the elevated shell portion 40 is beneficial for protecting the areas of the body prone to injury.

Furthermore, the cavity 24 is preferably filled with a non-pressurized gas 34 that may compress when the resilient outer shell 20 is deformed inwardly, but also provides at least a slight resisting force. As is known in the art, energy is required to compress a gas. In this respect, additional energy associated with the blow is absorbed when the non-pressurized gas 34 is compressed.

Figure 2C:
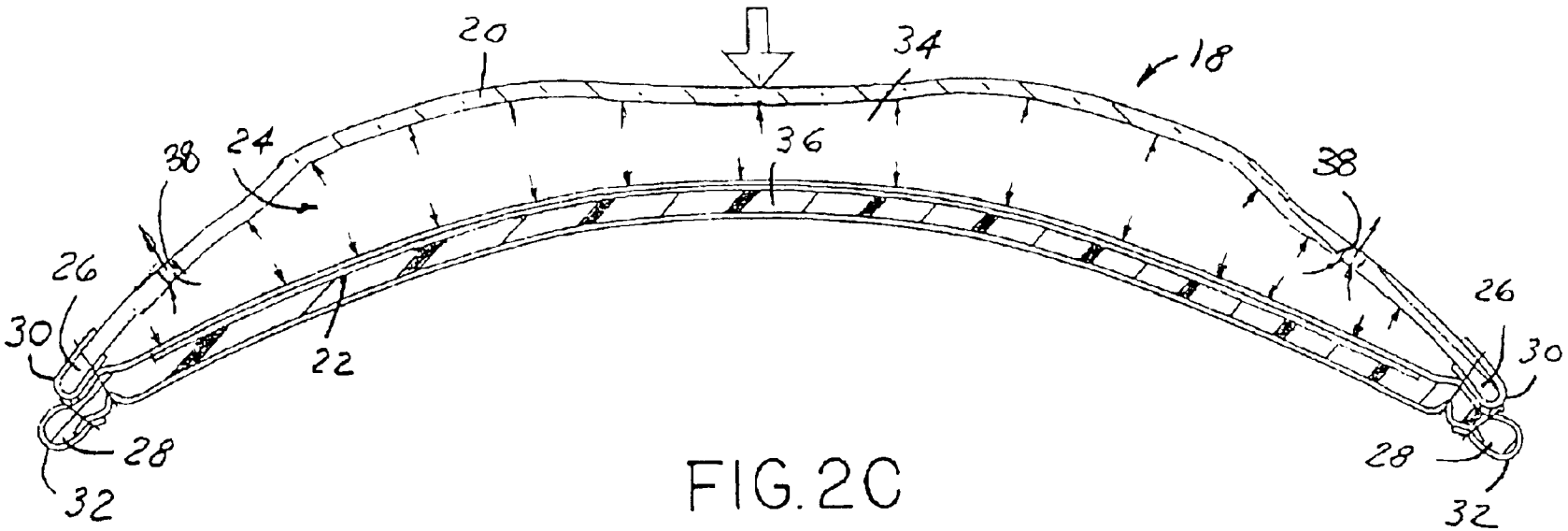
FIG. 2C is a cross-sectional view of a resilient force absorbing cap cushioning a blow, in accordance with an alternative embodiment of the present invention.

Moreover, the non-pressurized gas 34 may also evenly distribute the force of the blow across the surface area of the inner shell 22. As best shown in FIGS. 2B and 2C, the non-pressurized gas 34 exerts relatively equal pressure on the surface areas defining the cavity 24. A person skilled in the art will understand that spreading out the force of the blow decreases the probability of damage to the inner shell 22 and thus injury to the user. Consequently, weight, thickness, and overall strength requirements of the inner shell 22 are reduced. In contrast, one skilled in the art would understand that concentrating the force onto a discrete portion of the inner shell 22 may increase the probability of damage to the garment 10 and harm to the user. Such an adverse result would require greater weight, thickness, and overall strength requirements of the inner shell 22.

Preferably, the non-pressurized gas 34 is gas. However, it is understood that various other gasses may be disposed within the cavity 24. Moreover, the inner shell 22 is also preferably formed from a plastic material. However, the inner shell 22 preferably has a greater stiffness than the outer shell 20.

Each inner shell 22 also preferably includes an energy-absorbent padding 36 adhered or otherwise attached thereto. The padding 36 may be comprised of a minimized amount of foam padding or other compressible materials suitable for absorbing additional energy of a blow. The energy-absorbent padding 36 is also intended to provide for a comfortable fit of the garment 10 on the user.

It will also be understood that the amount of energy that the outer shell 20 is able to disperse will depend upon the height at which the outer shell 20 extends over the garment as well as the thickness of the material and the type of material. Therefore, it will be appreciated that the inner shell 22 can be eliminated if the cavity 24 is made larger to increase the length of deformation or if the material thickness or property is sufficient to disperse energy with the outer shell 20 making significant contact with the foam or other protector portion lying beneath the outer shell 20.

Referring now to FIG. 2C, there is shown a cross-sectional view of a resilient force absorbing cap 18 according to an alternative embodiment of the present invention. This cap 18 is substantially similar to the cap 18 disclosed in the preferred embodiment. In particular, the cap 18 includes a resilient outer shell 20 coupled to an inner shell 22 so as to leave a cavity 24 between the outer shell 20 and the inner shell 22. Also, the resilient outer shell 20 includes a boundary portion 26 that is attached to a peripheral portion 28 of the inner shell 22. The inner shell 22 may also have an energy-absorbent padding 36 adhered thereto, as disclosed in the preferred embodiment.

In contrast to the preferred embodiment described above, the alternative embodiment includes at least one relief port 38 integrated within the resilient outer shell 20, the inner shell 22, or both the resilient outer shell 20 and the inner shell 22. The relief port 38 is intended to permit a non-pressurized gas 34, preferably gas, within the cavity 24 to exit the cavity 24 when the resilient outer shell 20 is deformed inwardly. As one skilled in the art will understand, permitting the non-pressurized gas 34 to exit the cavity 18 prevents pressure from building therein. In doing so, less force is applied to the surface areas defining the cavity 24. As a result, the longevity of the outer shell 20 and the inner shell 22 are increased. When the force is removed from the resilient outer shell 20, the resilient outer shell 20 would return to its original shape and gas would reenter through the relief ports 38.

Figure 3:
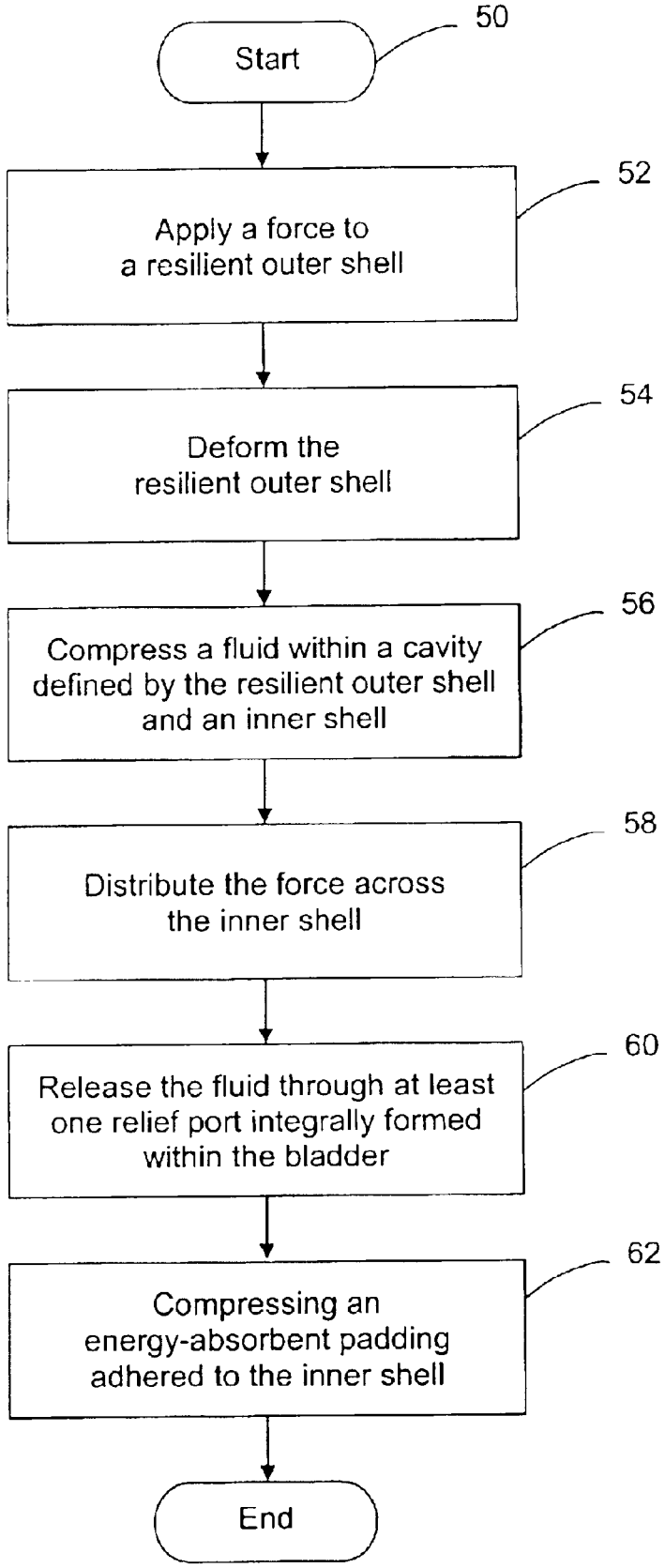
FIG. 3 is a flowchart depicting a method for cushioning a blow, in accordance with an alternative embodiment of the present invention.

Referring to FIG. 3, there is shown a flowchart depicting a method for cushioning a blow delivered to an individual's body, in accordance with a preferred embodiment of the present invention. The method commences at step 50 and immediately proceeds to step 52.

In step 52, a blow is delivered to the body of an individual wearing an upper body protective garment 10 or other body protective garment, as described above. This garment 10 includes at least one resilient shell 22 integrated therein for cushioning against the blow.

In particular, the force of the blow is imparted upon the resilient outer shell 20. The resilient outer shell 20 is preferably comprised of a flexible plastic material that can deform inwardly when it receives a force and then return to its original shape when the force is removed. However, it is understood that the resilient outer shell 20 may be comprised of various other suitable materials for absorbing energy. Also, this force may originate from a variety of circumstances, e.g. bumping into other players in a contact sport or being hit by a stick, such as a lacrosse head. The sequence then proceeds to step 54.

In step 54, the resilient outer shell 20 deforms inwardly and absorbs a portion of the energy associated with the blow. As is known in the art, deformation of material requires the absorption of energy. In this regard, the resilient outer shell 20 cushions against the blow. Then, the sequence proceeds to step 56.

In step 56, gas 34 within the cavity 24 is compressed as the resilient outer shell 20 deforms inwardly. A person skilled in the art also understands that energy is required to compress a gas. In this regard, additional energy associated with the blow is absorbed as the gas is compressed. The sequence then proceeds to step 58.

In step 58, the force of the blow is distributed across the surface area of the inner shell 22 or protector portion, e.g. foam padding, if the inner shell 22 is omitted. This step is accomplished by allowing the gas 34 to exert equal pressure on all surfaces defining the cavity 24. As a result, the force of the blow is dispersed across a relatively large area thereby reducing the likelihood of damage to the garment 10 or harm to the user. The sequence then proceeds to step 60.

In step 60, the gas 34 is released through a relief port 34 integrated within either the resilient outer shell 20 or the inner shell 22. As a result, pressure within the cavity 24 is decreased. The decreased pressure likewise decreases the likelihood of damage to the inner shell 22. In this respect, the weight, thickness, and overall strength requirements of the inner shell 22 are minimized thereby decreasing the weight and the raw material costs of the inner shell 22. The sequence then proceeds to step 62.

In step 62, an energy-absorbent padding 36 is compressed so as to receive additional energy from the blow. This padding 36 is preferably adhered or otherwise connected to the inner shell 22. In addition to cushioning against the force of the blow, the padding 36 is intended to provide for a comfortable fit of the garment 10 on the user.

While particular embodiments of the invention have been shown and described, numerous variations and alternate embodiments will occur to those skilled in the art. Accordingly, it is intended that the invention be limited only in terms of the appended claims.

What is claimed is:

1. An upper body protective garment comprising:

a chest protector portion;

a back protector portion; and a pair of shoulder protector portions in connection between said chest protector portion and said back protector portion;

a semi-hard resilient outer shell secured to said at least one of said chest protector portion, said back protector portion, or said pair of shoulder protector portions, said resilient outer shell for absorbing energy of a blow delivered thereto; and an inner shell coupled to said semi-hard resilient outer shell so as to leave a cavity between said outer shell and said inner shell.

2. The upper body protective garment of claim 1 wherein said resilient outer shell includes an elevated shell portion disposed at a substantial distance from said inner shell, said elevated shell portion intended to allow for substantial deformation of said resilient outer shell before contacting said inner shell.

3. The upper body protective garment of claim 2 said elevated shell portion is disposed slightly farther from said inner shell than a remaining portion of said resilient outer shell.

4. The upper body protective garment of claim 1 wherein a boundary of said resilient outer shell is coupled to a periphery of said inner shell.

5. The upper body protective garment of claim 4 wherein said boundary of said resilient outer shell is covered with a boundary guard for preventing said resilient outer shell from being damaged at said boundary.

6. The upper body protective garment of claim 4 wherein said periphery of said inner shell is covered with a periphery guard for preventing said inner shell from being damaged at said periphery.

7. The upper body protective garment of claim 1 further comprising an energy-absorbent padding coupled to said inner shell.

8. The upper body protective garment of claim 7 wherein said energy-absorbent padding is comprised of foam padding.

9. The upper body protective garment of claim 1 further comprising:

at least one arm protector coupled to at least one of said pair of shoulder protector portions.

10. The upper body protective garment of claim 9 wherein at least one of said resilient outer shell and said inner shell is comprised of a flexible thermal set plastic material.

11. An upper body protective garment comprising:

a chest protector portion;

a back protector portion; and a pair of shoulder protector portions in connection between said chest protector portion and said back protector portion;

a resilient outer shell integrated within at least one of said chest protector portion, said back protector portion, or said pair of shoulder protector portions, said resilient outer shell for absorbing energy of a blow delivered thereto; and an inner shell coupled to said resilient outer shell so as to leave a cavity therebetween, wherein said cavity is substantially free of any intervening absorbing structure;

wherein at least one of said at least one of said resilient outer shell and said inner shell have at least one relief port integrated therein for permitting a fluid within said cavity to exit and enter said cavity.

12. The upper body protective garment of claim 11 wherein said resilient outer shell includes an elevated shell portion disposed at a substantial distance from said inner shell, said elevated shell portion intended to allow for substantial deformation of said resilient outer shell before contacting said inner shell.

13. The upper body protective garment of claim 12 said elevated shell portion is disposed at least slightly farther from said inner shell than a remaining portion of said resilient outer shell.

14. The upper body protective garment of claim 11 wherein a boundary of said resilient outer shell is coupled to a periphery of said inner shell.

15. The upper body protective garment of claim 14 wherein said boundary of said resilient outer shell is covered with a boundary guard for preventing said resilient outer shell from being damaged at said boundary.

16. The upper body protective garment of claim 14 wherein said periphery of said inner shell is covered with a periphery guard for preventing said inner shell from being damaged at said periphery.

17. The upper body protective garment of claim 11 further comprising an energy-absorbent padding coupled to said inner shell.

18. A protective garment for protecting a portion of a wearer's body comprising:

a protector portion for substantially covering the portion of the wearer's body;

a semi-hard resilient outer shell in communication with said protector portion, said resilient outer shell being movable between a position spaced away from said protector portion to a inwardly flexed position in response to a force imparted thereto;

an inner shell in communication with said protector portion and constructed of a non-resilient material, said inner shell underlying at least a portion of said semi-hard resilient outer shell.

19. The garment of claim 18, wherein a cavity is formed between said resilient outer shell and said inner shell.

20. The garment of claim 19, wherein said cavity is substantially sealed.

21. The garment of claim 19, wherein said cavity is filled with non-pressurized gas.

22. The garment of claim 18, wherein said resilient outer shell further includes an elevated portion that is disposed farther away from said inner shell than the other portions of said resilient outer shell.

23. The garment of claim 18, wherein a boundary of said resilient outer shell is coupled to a periphery of said inner shell.

24. The garment of claim 18, wherein a boundary of said resilient outer shell is coupled adjacent to a periphery of said inner shell.

25. The garment of claim 18 further comprising:

an energy-absorbent padding coupled to said inner shell.

26. The garment of claim 23, wherein said energy-absorbent padding is constructed of foam.

27. The garment of claim 18, wherein said resilient outer shell is constructed of a plastic material.

28. The garment of claim 19, wherein said resilient outer shell has at least one relief port integrated therein for permitting a gas to enter and exit said cavity.

29. The garment of claim 18, wherein the portion of the wearer's body is the upper body.

30. The garment of claim 18, wherein the portion of the wearer's body is the hand.

31. The garment of claim 18, wherein the portion of the wearer's body is a shoulder.

32. The garment of claim 18, wherein the portion of the wearer's body is a knee.

* * * * *